US011672065B1

(12) United States Patent
Chen et al.

(10) Patent No.: US 11,672,065 B1
(45) Date of Patent: Jun. 6, 2023

(54) AUTOMOTIVE LIGHTING UNIT FOR DETECTING ELECTRICAL CHARACTERISTICS OF LIGHT EMITTER DIODE COMPONENT

(71) Applicant: EXCELLENCE OPTO. INC., Miaoli County (TW)

(72) Inventors: Fu-Bang Chen, Miaoli County (TW); Yung-Hsiang Chao, Miaoli County (TW); Tsung-Hsiang Chen, Miaoli County (TW); Chang-Ching Huang, Miaoli County (TW); Kuo-Hsin Huang, Miaoli County (TW)

(73) Assignee: EXCELLENCE OPTO. INC., Hsinchu Science Park (TW)

( * ) Notice: Subject to any disclaimer, the term of this patent is extended or adjusted under 35 U.S.C. 154(b) by 0 days.

(21) Appl. No.: 17/718,949

(22) Filed: Apr. 12, 2022

(51) Int. Cl.

| | |
|---|---|
| ***H05B 45/50*** | (2022.01) |
| ***F21S 41/141*** | (2018.01) |
| ***H05B 45/14*** | (2020.01) |
| ***H05B 45/34*** | (2020.01) |
| ***H05B 45/345*** | (2020.01) |
| ***H05B 45/36*** | (2020.01) |
| *F21Y 115/10* | (2016.01) |

(52) U.S. Cl.
CPC ..... *H05B 45/50* (2020.01); *F21S 41/141* (2018.01); *H05B 45/14* (2020.01); *H05B 45/34* (2020.01); *H05B 45/345* (2020.01); *H05B 45/36* (2020.01); *F21Y 2115/10* (2016.08)

(58) Field of Classification Search
None
See application file for complete search history.

(56) References Cited

U.S. PATENT DOCUMENTS

2018/0049301 A1* 2/2018 Brombach ..... B60Q 11/002
2019/0098710 A1* 3/2019 Murakami ..... H05B 45/00

* cited by examiner

*Primary Examiner* — Anh Q Tran
(74) *Attorney, Agent, or Firm* — Muncy, Geissler, Olds & Lowe, P.C.

(57) ABSTRACT

The invention provides an automotive lighting unit for detecting electrical characteristics of light emitter diode component. At least one light emitter diode light source is selectively disposed on any one of at least one circuit channel of at least one drive power loop. At least one circuit breaker comprises at least one circuit switch corresponding to the at least one drive power loop, and is disposed on the circuit channel with the at least one light emitter diode light source. The at least one circuit channel is controlled by the at least one circuit switch to turn in a state of isolating from a drive power. An ammeter connection line is connected with the two sides one of the at least one light emitter diode light source.

16 Claims, 9 Drawing Sheets

AUTOMOTIVE LIGHTING UNIT FOR DETECTING ELECTRICAL CHARACTERISTICS OF LIGHT EMITTER DIODE COMPONENT

FIELD OF THE INVENTION

The present invention relates to a light emitter diode automotive lighting unit, in particular to an automotive lighting unit capable of directly and accurately detecting the electrical characteristics of a semiconductor of LED chips of a light emitter diode light source therein.

BACKGROUND OF THE INVENTION

A light emitter diode (LED) is a high-brightness light source capable of being generated by using recombination of electrons of a semiconductor and holes and has been widely used for a head light, a tail light or other automotive exterior lights (of blue-yellow light, orange light, red light, white light and infrared ray). In addition to high luminosity and high luminous density, the high-quality high-power light emitter diode further requires good reliability. With automotive lighting unit as an example, once the light emitter diode fails, the night driving safety would be affected. With high-standard specifications of an automotive light emitter diode, the light emitter diode still requires to be improved in the automobile industry although failing by a trace amount of 1 ppm, and therefore, accurate optical and electrical property detectability of a component is very important.

A manufacture procedure of the automotive lighting unit is approximately as follows: an epitaxial wafer is manufactured into light emitter diode (LED) chips of a PN junction of the semiconductor firstly, then the chips are manufactured into a light emitter diode packaging component, then the light emitter diode packaging component is manufactured into a light-emitting automotive lighting module (PCBA), and finally, the light-emitting automotive lighting module is manufactured into the automotive lighting unit to be used for an automobile. Relatively to a traditional tungsten lamp bulb or fluorescent lamp bulb light source, although being relatively high in cost, the light emitter diode light source has the advantages of high starting speed and more safety and further has the property of light source blocks and good directivity. Therefore, the light emitter diode light source has wide application with respect to road lighting when being used for the head light, for example, may be matched with a sensor to achieve strengthened lighting in a specific area or achieve a function of local automatic light shielding for an opposite lane. As sudden failure of the head light would affect the active driving safety, a night traffic accident may be caused if the head light is subjected to an unexpected damage during night driving.

Referring to FIG. 1, an automotive lighting has two light source modules which are a dipped headlight light source module 1A and a high beam light source module 1B and are placed in a light housing 3 of an automotive lighting unit 2; an LED drive module (LDM) 4 is disposed in a sealed space of the light housing 3; a drive power supply in the LED drive module 4 has two portions which are a dipped headlight control unit 4A and a high beam control unit 4B; and the dipped headlight control unit 4A and the high beam control unit 4B may provide power to a drive power loop A and a drive power loop B respectively to achieve turning on or brightness adjustment of the dipped headlight light source module 1A and the high beam light source module 1B.

With the dipped headlight light source module 1A as an example, the dipped headlight control unit 4A provides a direct-current drive power to achieve luminous actuation of the dipped headlight light source module 1A of the drive power loop A; the drive power loop A has two parallel current channels A1 and A2; the current channel A1 is provided with an LED component of the dipped headlight light source module 1A; the current channel A2 is provided with an antistatic protection component 1C for protecting the LED component; the antistatic protection component 1C is an unilateral Zener diode component (Zener Diode); a P electrode and an N electrode of the unilateral Zener diode component require to be opposite to the LED component in polarity; in the case that the LED component of the dipped headlight light source module 1A is subjected to forward biased operation, a current of the unilateral Zener diode component cannot pass through the LED component; and only when highly reverse bias is applied to the LED component of the dipped headlight light source module 1A, the unilateral Zener diode component can have the efficacy of protecting circulation. In the conventional techniques, the LED component of the dipped headlight light source module 1A may have better efficacy of resisting the static electricity and a surge if being connected in parallel with the antistatic protection component 1C of the dipped headlight light source module 1A; and there is also the automotive lighting designed not to use the antistatic protection component 1C or the antistatic protection component 1C designed in the LED drive module 4.

In FIG. 1: the dipped headlight light source module 1A and the high beam light source module 1B have different drive power loops A, B; starting points of currents of the dipped headlight light source module 1A and the high beam light source module 1B are positive terminals of the LED components of the dipped headlight light source module 1A and the high beam light source module 1B respectively; and the currents collectively converge at the negative terminals of the LED components of the dipped headlight light source module 1A and the high beam light source module 1B and return to the drive power supply of the LED drive module 4.

The LED drive module 4 is electrically connected with an automotive body controller (body control module) 6 by virtue of a connector 5 outside the light housing 3, and a battery 7 in the automobile is electrically connected with the automotive body controller 6. The automotive body controller 6 controls and manages various automotive lighting functions through the LED drive module 4.

The automotive lighting unit 2 comprises all features in the light housing 3 and the connector 5 outside the light housing 3. In order to protect against water and moisture, the automotive lighting unit 2 is designed as a sealed space; LED chips of the dipped headlight light source module 1A and the high beam light source module 1B are operated under the condition with high current and high temperature; and the LED components of the dipped headlight light source module 1A and the high beam light source module 1B are generally parts which are most easily damaged in the automotive lighting unit 2.

Referring to FIG. 2, a current-voltage (I-V) characteristic curve diagram of LED chips is shown. With respect to the LED chips, detectable items include: forward voltage $V_{f1}$ in a forward current $I_{f1}$, forward voltage $V_{f2}$ in a very small forward current $I_{f2}$ and a reverse leakage current Ir at reverse voltage Vr. For example, with gallium nitride blue chips with an area of 1 mm2 as an example, when the forward current $I_{f1}$ is 350 mA, the corresponding forward voltage $V_{f1}$ is approximately 3.0V. In addition, when the very small forward current $I_{f2}$ is 10 μA, the corresponding forward voltage $V_{f2}$ is approximately 2.7V. When the reverse voltage Vr is −5V, the corresponding reverse leakage current Ir is approximately 0.02 μA.

If the LED chips are in poor contact or a semiconductor layer of the LED chips is abnormal in electric conduction, the forward voltage $V_{f1}$ in the forward current $I_{f1}$ can rise; and if an epitaxial material of a PN junction of a semiconductor of the LED chips deteriorates, the reverse leakage current Ir at the reverse voltage Vr may increase, and the forward voltage $V_{f2}$ in the very small forward current Ire can decrease at the same time.

Such characteristic may reflect the electrical characteristics of the LED chip, which may be used for identifying whether the LED chips are normal or not, comparing a change on time by a numerical value and even estimating the service life of the abnormal LED chips.

However, it is traditionally known that the dipped headlight light source module 1A and the high beam light source module 1B are sealed in the light housing 3, and positive and negative electrodes of the LED chips of the dipped headlight light source module 1A and the high beam light source module 1B are connected with the LED drive module 4. If the LED chips are directly externally connected with an anode and a cathode for measurement, the LED chips can be connected with the LED drive module 4 to form a parallel circuit, and at this moment, the electrical characteristics at the forward voltage and the reverse voltage of the LED chips of the dipped headlight light source module 1A and the high beam light source module 1B cannot be accurately measured, which causes difficult judgment on quality of the PN junction of the semiconductor of the LED chips and chip packaging. In addition, the LED chips of the dipped headlight light source module 1A and the high beam light source module 1B are located in the light housing 3, and it is also very difficult to disassemble the light housing 3 for error detection.

SUMMARY OF THE INVENTION

A main objective of the present invention is to provide an automotive lighting unit for detecting the electrical characteristics of a light emitter diode component, in which a to-be-tested light emitter diode light source is in a state of isolating from a drive power so as to eliminate interference of external factors; and then positive electrodes and negative electrodes of LED chips of the light emitter diode light source are sequentially measured, the material conditions of each LED chip of the light emitter diode light source may be correctly evaluated, and then the LED chips with doubt about reliability are found. The LED chips of the light emitter diode light source may further be monitored for a long time, and the condition of an abnormal component may be monitored.

The present invention provides an automotive lighting unit for detecting electrical characteristics of a light emitter diode component, comprising an automotive lighting housing, an LED drive module, a power and control cable, at least one light emitter diode light source, at least one drive power loop, at least one circuit breaker, and an ammeter connection line. The automotive lighting housing comprises an automotive lighting housing interior space. The LED drive module is disposed in the automotive lighting housing interior space and comprising at least one drive power supply, wherein each of the at least one drive power supply comprises a power supply positive terminal and a power supply negative terminal outputting a drive voltage. The power and control cable penetrates through the automotive lighting housing and electrically connected with the LED drive module.

The at least one drive power loop is correspondingly connected with the at least one drive power supply, wherein each of the at least one drive power loop is disposed in the automotive lighting housing interior space and comprises a first terminal and a second terminal, the first terminal is connected with the power supply positive terminal, the second terminal is connected with the power supply negative terminal, at least one circuit channel is provided between the first terminal and the second terminal, and the at least one light emitter diode light source is selectively disposed on any one of the at least one circuit channel.

The at least one circuit breaker is correspondingly disposed on the at least one drive power loop, the at least one circuit breaker comprises at least one circuit switch disposed on the at least one circuit channel with the at least one light emitter diode light source, wherein the circuit breaker is in an on-state when the at least one circuit switch is controlled to be connected, and the circuit breaker is in an off-state when the at least one circuit switch is controlled to be disconnected, and when the circuit breaker is in the off-state, the corresponding at least one light emitter diode light source is isolated from a driving power.

The ammeter connection line comprises at least one positive electrode line and at least one negative electrode line, the at least one positive electrode line and the at least one negative electrode line of the ammeter connection line are provided in pairs and are respectively connected to two sides of one of the at least one light emitter diode light source.

Accordingly, the light emitter diode light source, on the same circuit channel with the drive power, may be in the state of isolating from the drive power by enabling the circuit breaker to be in the off-state, so that the light emitter diode light source cannot be affected by external voltage, such as a parallel loop. Therefore, chip detection may be conducted on the at least one light emitter diode light source by virtue of the ammeter connection line in sequence, whether the electrical characteristics of the LED chips of the at least one light emitter diode light source are normal or not may be estimated through numerical values of measurement data of the current source electric meter, so as to discover whether the LED chips are damaged or to be damaged. In addition, a change on time by the numerical values of the electrical characteristics may be compared, and the residual life of abnormal LED chips in the at least one light emitter diode light source may be estimated, so that sudden failure of the at least one light emitter diode light source during driving is avoided so as to maintain the driving safety.

DETAILED DESCRIPTION OF THE PREFERRED EMBODIMENTS

Figure 3:
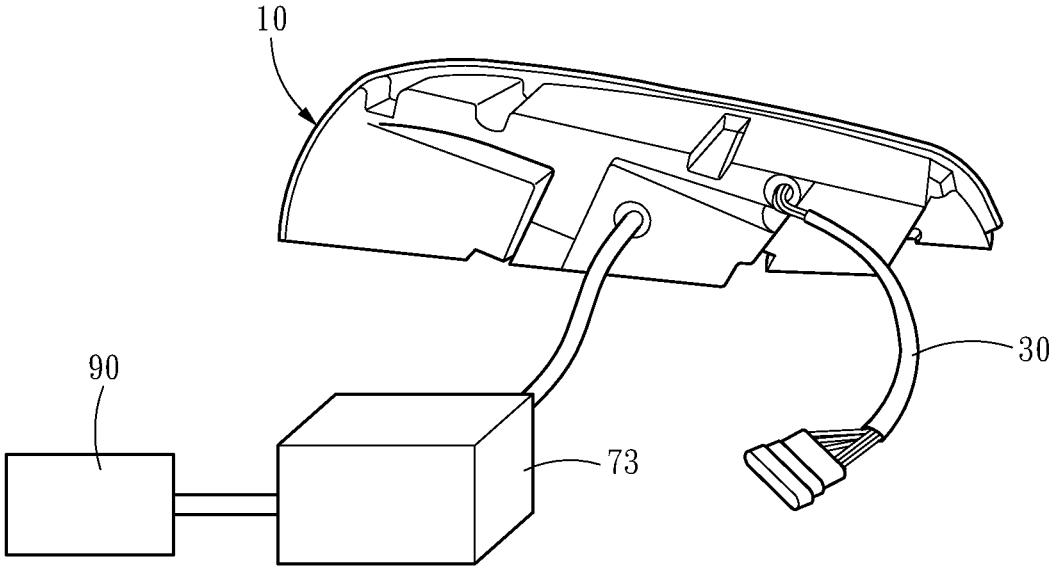
FIG. 3 is a schematic diagram of an appearance of an automotive lighting unit of the present invention.
Figure 4:
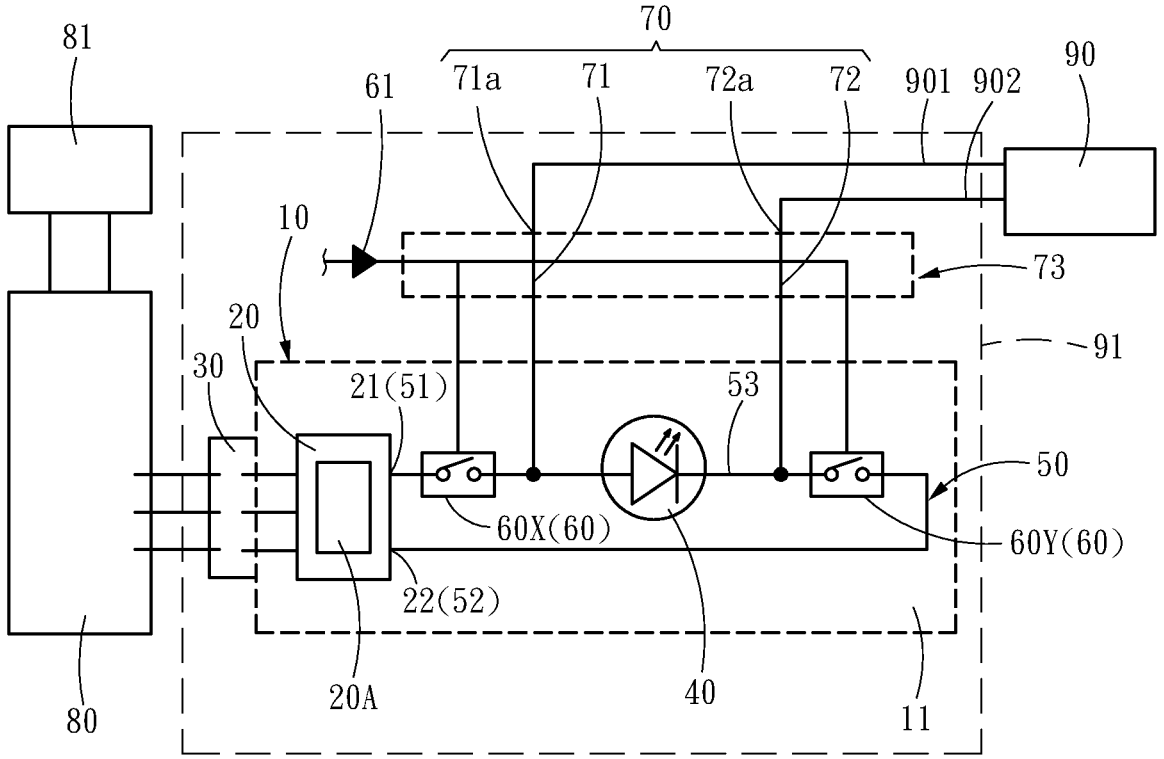
FIG. 4 is a first schematic diagram according to the first embodiment of the present invention.

In order to make deeper understanding and identification on the features, the objective and the efficacy of the present invention for better understanding, description is taking an example of one preferred embodiment in cooperation with the drawings as follows:

Please refer to FIG. 3 and FIG. 4, which show an overall appearance of an automotive lighting unit and the first embodiment of the present invention. The automotive lighting unit comprises an automotive lighting housing 10, a light emitter diode (LED) drive module (LDM) 20, a power and control cable 30, at least one light emitter diode light source 40, at least one drive power loop 50, at least one circuit breaker 60 and an ammeter connection line 70. The automotive lighting housing 10 comprises an automotive lighting housing interior space 11 therein, and the LED drive module 20 is disposed in the automotive lighting housing interior space 11. The LED drive module 20 comprises at least one drive power supply 20A, and each of the at least one drive power supply 20A comprises a power supply positive terminal 21 for outputting a drive voltage and a power supply negative terminal 22. The power and control cable 30 penetrates through the automotive lighting housing 10 to electrically connect with the LED drive module 20, and the power and control cable 30 receives electric power from a battery 81 through an automotive body controller 80 which is connected with the power and control cable 30 and the battery 81.

The at least one drive power loop 50 is correspondingly connected with the at least one drive power supply 20A, and each of the at least one drive power loop 50 is disposed in the automotive lighting housing interior space 11. Each of the at least one drive power loop 50 comprises a first terminal 51 and a second terminal 52, the first terminal 51 is connected with the power supply positive terminal 21, and the second terminal 52 is connected with the power supply negative terminal 22. At least one circuit channel 53 is provided between the first terminal 51 and the second terminal 52, and the at least one light emitter diode light source 40 is selectively disposed on any one of the at least one circuit channel 53. In this embodiment, the automotive lighting unit comprises one drive power supply 20A and one drive power loop 50 are provided. In other embodiments, the automotive lighting unit comprises a plurality of drive power supplies 20A and a plurality of drive power loops 50, and the plurality of drive power loops 50 are correspondingly connected to the plurality of drive power supplies 20A in the LED drive module 20 so as to independently control switches and a luminous intensity. Further, in one embodiment, each of the at least one drive power loop 50 comprises one circuit channel 53; and in other embodiment, a plurality of circuit channels 53 connected in parallel are provided instead. The plurality of circuit channels 53 are provided for disposal of one of the at least one light emitter diode light source 40 or other functional components. In one embodiment, the automotive lighting unit comprises one light emitter diode light source 40; and in other embodiment, a plurality of light emitter diode light sources 40 connected in series are provided.

The circuit breaker 60 is composed of a circuit switch 60X at the front end and a circuit switch 60Y at the rear end. It is necessary for each of the at least one drive power loop 50 to be provided with at least one of the circuit switch 60X or the circuit switch 60Y to break the loop. Preferably, the circuit switch 60X and/or the circuit switch 60Y is disposed on the circuit channel 53 with the at least one light emitter diode light source 40. The circuit breaker 60 has an on-state and an off-state by controlling the circuit switch 60X and/or the circuit switch 60Y to be connected or disconnected.

Moreover, when the circuit breaker 60 is in the off-state, the at least one light emitter diode light source 40 corresponded is in a state of isolating from the drive power. At this time, the at least one light emitter diode light source 40 is electrically connected with the ammeter connection line 70, wherein one end of the ammeter connection line 70 penetrates through the automotive lighting housing 10 and is connected to the two sides of the at least one light emitter diode light source 40, and the other end of the ammeter connection line 70 is connected to a current source electric meter 90.

The ammeter connection line 70 comprises at least one positive electrode line 71 and at least one negative electrode line 72. In the embodiment that a plurality of light emitter diode light sources 40 is provided, the at least one positive electrode line 71 and the at least one negative electrode line 72 are provided in pairs and are selectively connected with the two sides of any one of the at least one light emitter diode light source 40, the positive electrode line 71 and the negative electrode line 72 in pairs are electrically connected to a positive line 901 and a negative line 902 of the current source electric meter 90, respectively according to an electrical property. In FIG. 4, a portion encircled by an outer frame dotted line 91 is the automotive lighting unit of the present invention.

In an embodiment, the automotive lighting housing 10 is selected from any one of a head light, a fog light, a tail light, a side light and a projection headlight. The circuit switch 60X (60Y) of the at least one circuit breaker 60 is electronically controlled circuit switch selected from any one of a relay and a semiconductor transistor. Also, in one embodiment, the present invention further comprises an electrical measurement connection box 73 (shown in dotted line so as to be distinguished from the electrode lines). The ammeter connection line 70 is disposed in the electrical measurement connection box 73, wherein a positive external measurement point 71*a* on one end of the positive electrode line 71 and a negative external measurement point 72*a* on one end of the negative electrode line 72 are disposed on the surface of the electrical measurement connection box 73. The other ends of the positive electrode line 71 and the negative electrode line 72 are penetrate through the automotive lighting housing 10 and are connected to the two sides of the at least one light emitter diode light source 40. The positive line 901 of the current source electric meter 90 is connected to the positive electrode line 71 by electrically contacting with the positive external measurement point 71*a*; similarly, the negative line 902 of the current source electric meter 90 is connected to the negative electrode line 72 by electrically contacting with the negative external measurement point 72*a*.

Referring to the first embodiment shown in FIG. 4, the circuit switch 60X (60Y) of the at least one circuit breaker 60 is disposed in the automotive lighting housing 10 and is electronically controlled circuit switches, and an electrical control signal is provided by an external electrical control signal cable 61 outside the automotive lighting housing 10. The external electrical control signal cable 61 is penetrated through the electrical measurement connection box 73 and then extended into the automotive lighting housing 10 to be connected with the circuit switch 60X (60Y).

As shown in FIG. 4, a measurement state in the first embodiment is shown, wherein the positive external measurement point 71*a* and the negative external measurement point 72*a* are electrically connected with the positive line 901 and the negative line 902 of the current source electric meter 90, respectively. As shown in FIG. 4, the circuit switch 60X (60Y) of the circuit breaker 60 is in the off-state (drawn as hollow dots) based on a control signal provided by the external electrical control signal cable 61, and the at least one light emitter diode light source 40 is in the state of isolating from the drive power, and therefore, the at least one light emitter diode light source 40 is connected to the ammeter connection line 70 and be tested by the current source electric meter 90. If a plurality of light emitter diode light sources 40 are provided, the ammeter connection line 70 is used to be selectively connected to the two sides of any one of the light emitter diode light sources 40 for testing. Therefore, the at least one light emitter diode light source 40 is detected without interfered by external factors, and the micro current characteristics of the LED chips in the at least one light emitter diode light source 40 are accurately measured at forward bias and reverse bias, so that a quality characteristic of the LED chips of the at least one light emitter diode light source 40 is correctly estimated, and a reference for replacing automobile service and maintenance is provided.

Figure 5:
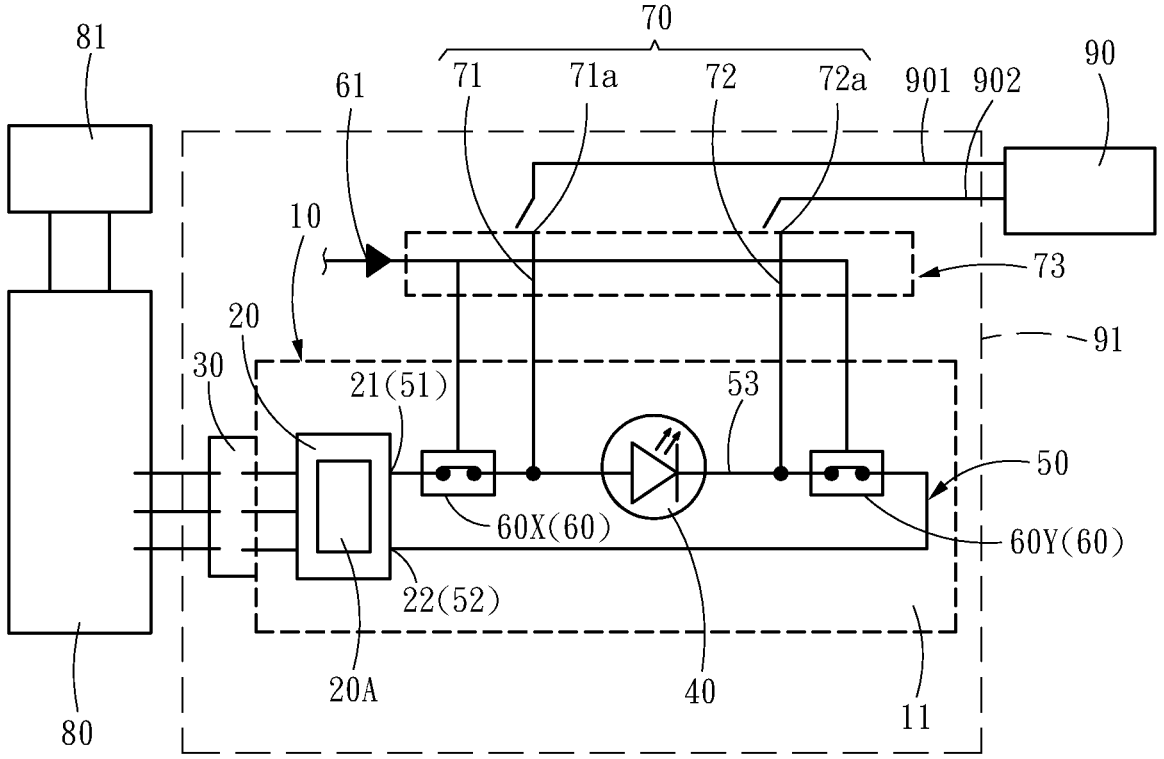
FIG. 5 is a second schematic diagram according to the first embodiment of the present invention.

Referring to FIG. 5, an operation state in the first embodiment (the at least one light emitter diode light source 40 is turned on to be used for automotive lighting) is shown. The circuit breaker 60 on the drive power loop 50 is in the on-state based on a control signal provided by the external electrical control signal cable 61, which means that the circuit switch 60X (60Y) is in the on-state (drawn as solid dots).

Figure 1:
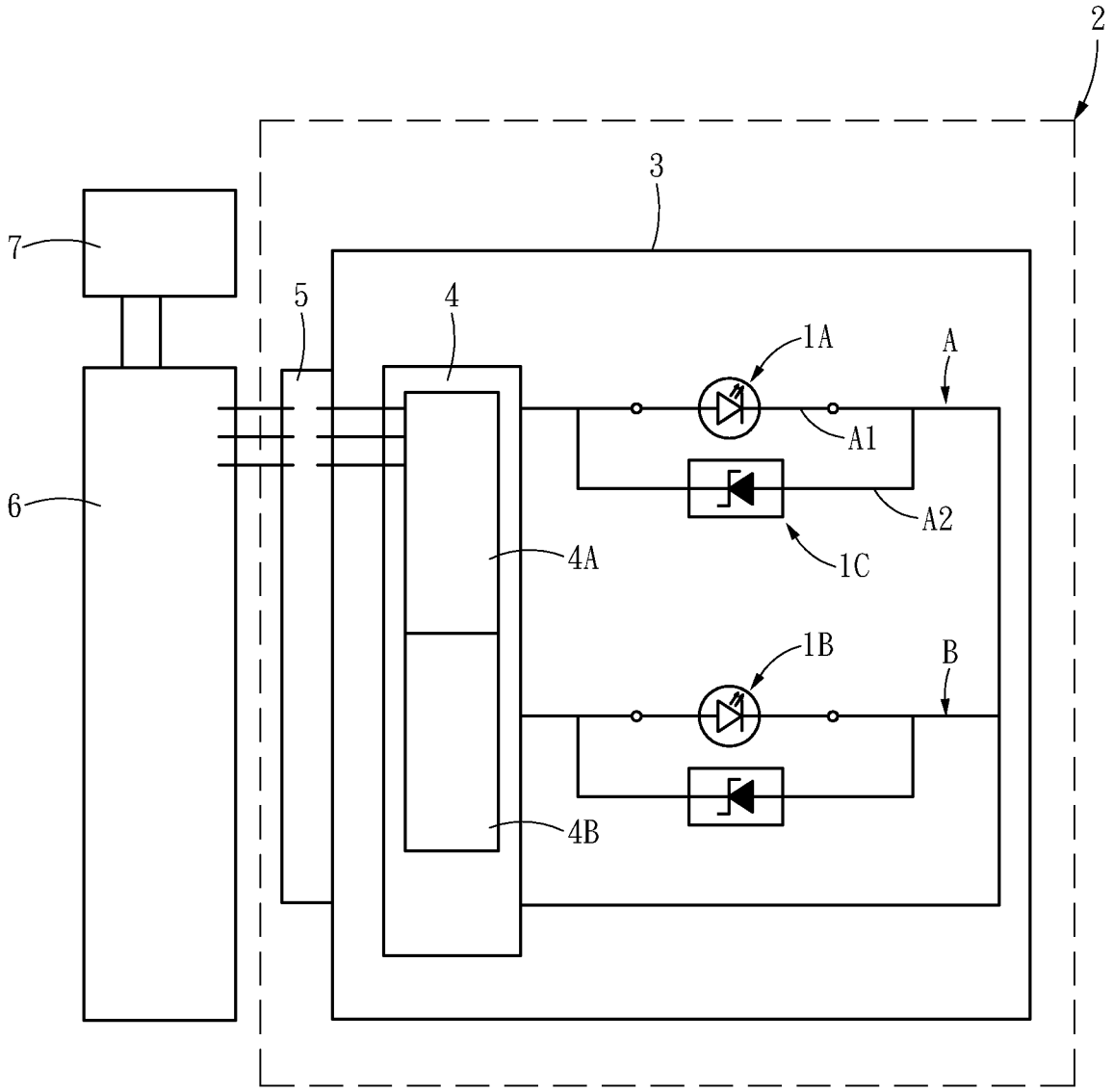
Fig. 1 PRIOR ART
FIG. 1 is a schematic diagram of a traditional automotive lighting unit.
Figure 2:
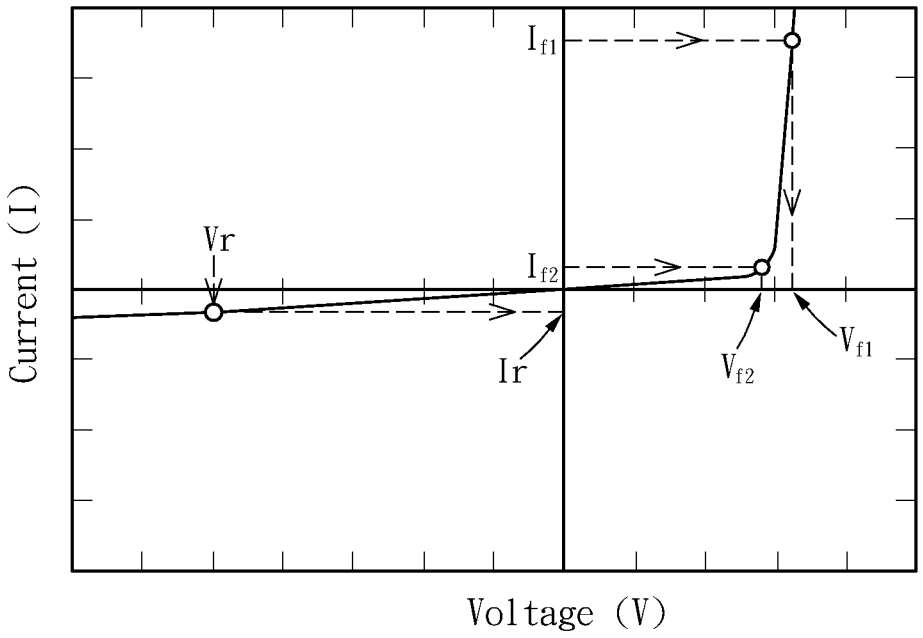
FIG. 2 is a current-voltage (I-V) characteristic curve schematic diagram of LED chips.

In addition, the positive external measurement point 71*a* and the negative external measurement point 72*a* are disconnected with the positive line 901 and the negative line 902 of the current source electric meter 90 (drawn as open circuits), that is, the two sides of the at least one light emitter diode light source 40 are isolated from the current source electric meter 90. The aforementioned circuit may normally provide lighting during driving, as shown in the schematic diagram of a traditional automotive lighting unit in FIG. 1.

Figure 6:
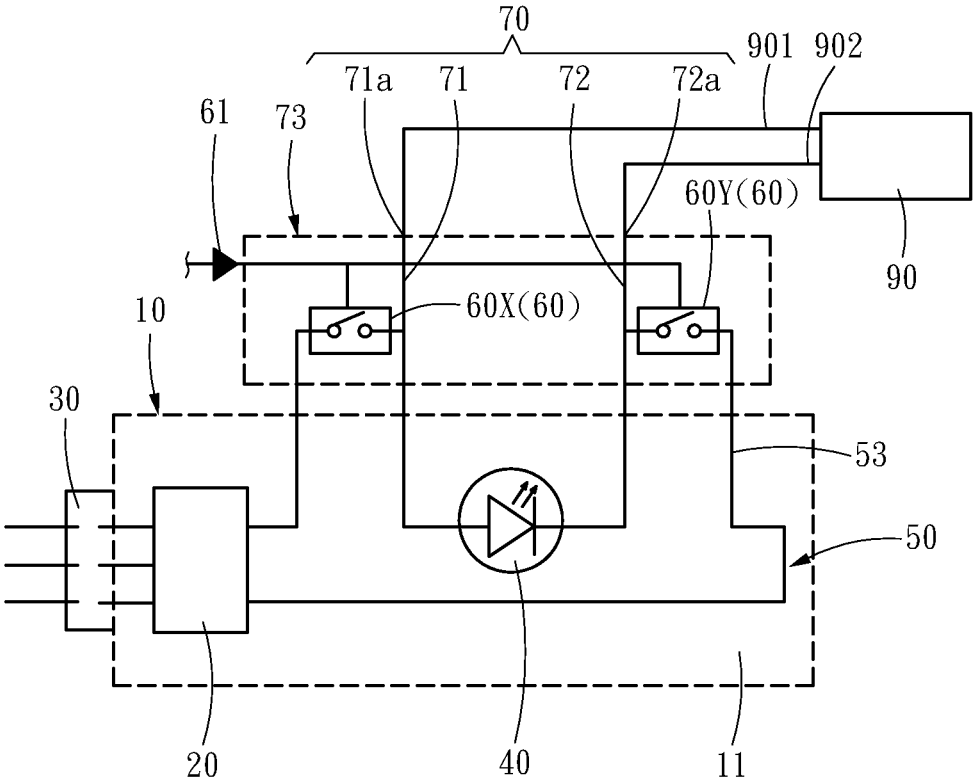
FIG. 6 is a first schematic diagram of the automotive lighting unit according to the second embodiment of the present invention.
Figure 7:
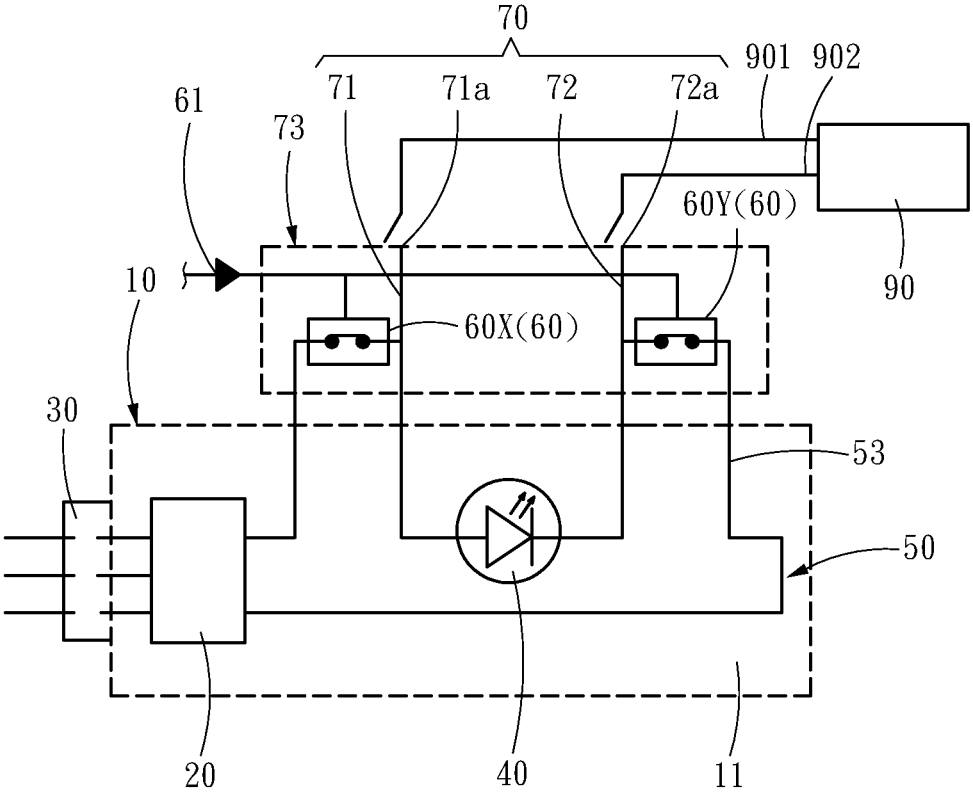
FIG. 7 is a second schematic diagram of the automotive lighting unit according to the second embodiment of the present invention.

Referring to FIG. 6 and FIG. 7, the schematic diagrams of the automotive lighting unit according to the second embodiment of the present invention are shown. In the embodiment, one circuit breaker 60 with two circuit switches 60X, 60Y are provided as an example. The circuit switches 60X, 60Y of the at least one circuit breaker 60 are disposed in the electrical measurement connection box 73, and the circuit switches 60X, 60Y are electronically controlled circuit switches which are controlled by electrical control signals provided by the external electrical control signal cable 61 outside the electrical measurement connection box 73.

In a measurement state of the second embodiment shown in FIG. 6, the circuit switches 60X, 60Y of the circuit breaker 60 are in the off-state (drawn as hollow dots) bases on control signals provided by the external electrical control signal cable 61, and the positive line 901 and the negative line 902 of the current source electric meter 90 are electrically connected with the positive external measurement point 71*a* and the negative external measurement point 72*a*, respectively. Therefore, the at least one light emitter diode light source 40 is connected to the ammeter connection line 70, wherein if a plurality of light emitter diode light sources 40 are provided, the ammeter connection line 70 is used to be selectively connected to the two sides of any one of the light emitter diode light sources 40 for testing.

In an operation state in the second embodiment as shown in FIG. 7, the circuit breaker 60 is in the on-state (drawn as solid dots) based on control signals provided by the external electrical control signal cable 61, and the ammeter connection lines 70 is disconnected with the positive external measurement point 71*a* and the negative external measurement point 72*a*, that is, the ammeter connection lines 70 is not connected with the two sides of the at least one light emitter diode light source 40, and the at least one light emitter diode light source 40 is able to provide the lighting during driving as normal.

Figure 8:
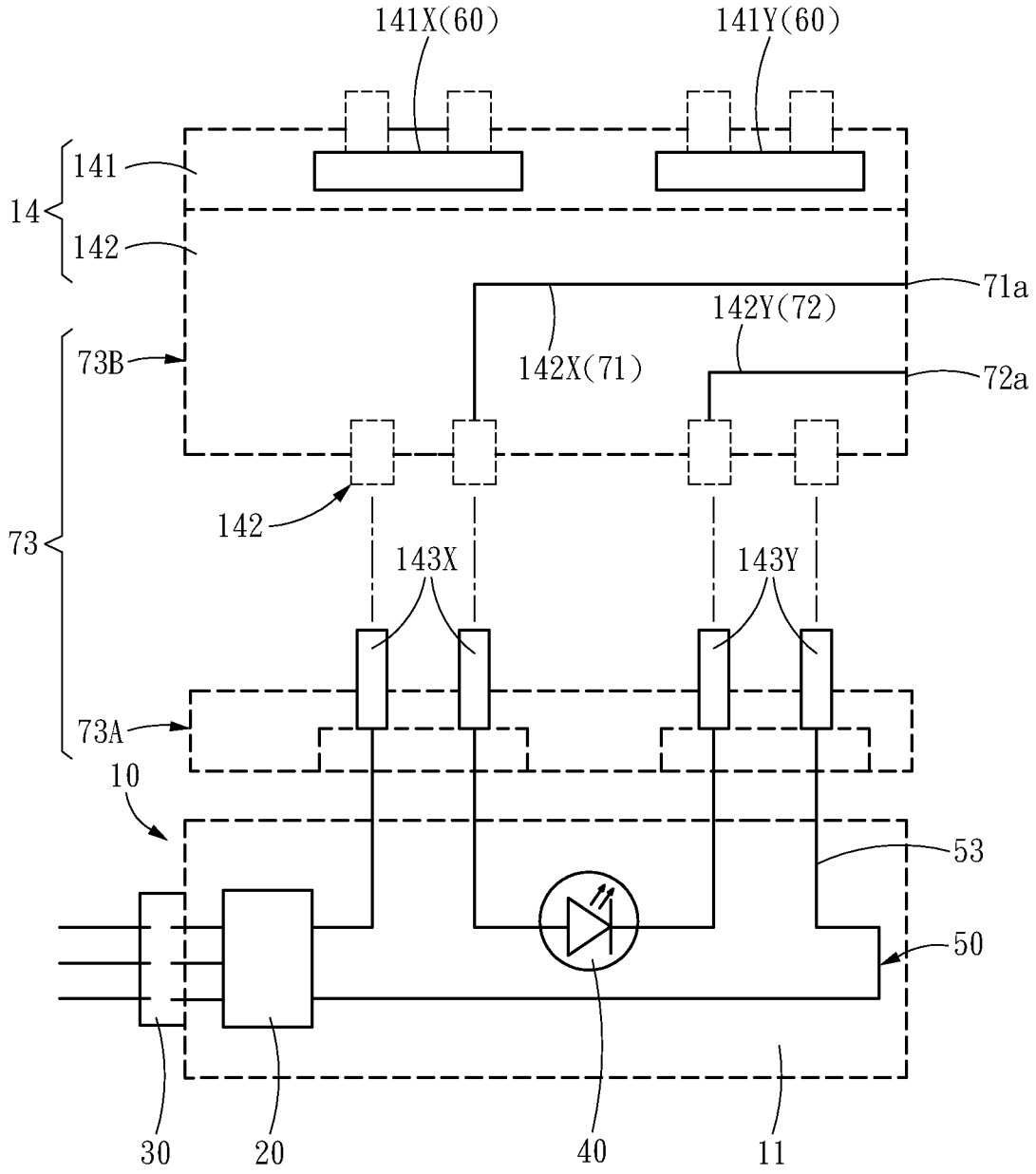
FIG. 8 is a schematic diagram of a two-headed plug according to the third embodiment of the present invention.

Referring to FIG. 8, the schematic diagram of the automotive lighting unit according to the third embodiment of the present invention is shown. In this embodiment, the electrical measurement connection box 73 comprises a first connector 73A and a second connector 73B, and the electrical measurement connection box 73 has a function of manually controlling the circuit switches. The second connector 73B is a double-ended connector 14 which comprises a first connection portion 141 and a second connection portion 142, wherein a position that the first connection portion 141 relative to the second connection portion 142 is any one selected from a same side, an adjacent side and an opposite side of the double-ended connector 14. In the embodiment shown in FIG. 8, the first connection portion 141 and the second connection portion 142 are arranged at the opposite sides. Also, in one embodiment, the first connection portion 141 and the second connection portion 142 of the double-ended connector 14 are formed by combining two separate features; that is, the first connection portion 141 and the second connection portion 142 are separate features and are disassembled or assembled according to the requirement. The assembling method thereof may be achieved by using adhesion, buckling and the like.

The circuit channel 53 with the at least one light emitter diode light source 40 extends into the first connector 73A twice to form two circuit-breaker points 143X, 143Y in the first connector 73A. The light emitter diode light source 40 is disposed between the two circuit-breaker points 143X, 143Y The first connection portion 141 comprises two electrical connection portions 141X, 141Y which are able to be connected to the circuit-breaker points 143X, 143Y respectively to be served as the circuit breaker 60; and the second connection portion 142 comprises two connection lines 142X, 142Y which are served as the positive electrode line 71 and the negative electrode line 72 respectively. One ends of the positive electrode line 71 and the negative electrode line 72 are connected to the two sides of the light emitter diode light source 40 respectively, and the other ends of the positive electrode line 71 and the negative electrode line 72 are connected to the positive external measurement point 71*a* and the negative external measurement point 72*a* respectively.

As shown in FIG. 8, the first connector 73A and the second connector 73B are selectively connected along the chain-dotted lines. When the two connection lines 142X, 142Y of the second connection portion 142 are respectively connected to the two circuit-breaker points 143X, 143Y, the at least one light emitter diode light source 40 is in the state of isolating from the drive power, and the positive external measurement point 71*a* and the negative external measurement point 72*a* are externally connected to the current source electric meter 90 (referring to FIG. 4) for measurement. The external current source electric meter 90 measures the values of the characteristics of micro and precision currents and voltages applied to the LED chips of the at least one light emitter diode light source 40 at the forward bias and the reverse bias. Further, when the second connector 73B is reversed, and the two electrical connection portions 141X, 141Y of the first connection portion 141 are respectively connected to the two circuit-breaker points 143X, 143Y, the two circuit-breaker points 143X, 143Y are conducted and the at least one light emitter diode light source 40 emits light normally.

Figure 9:
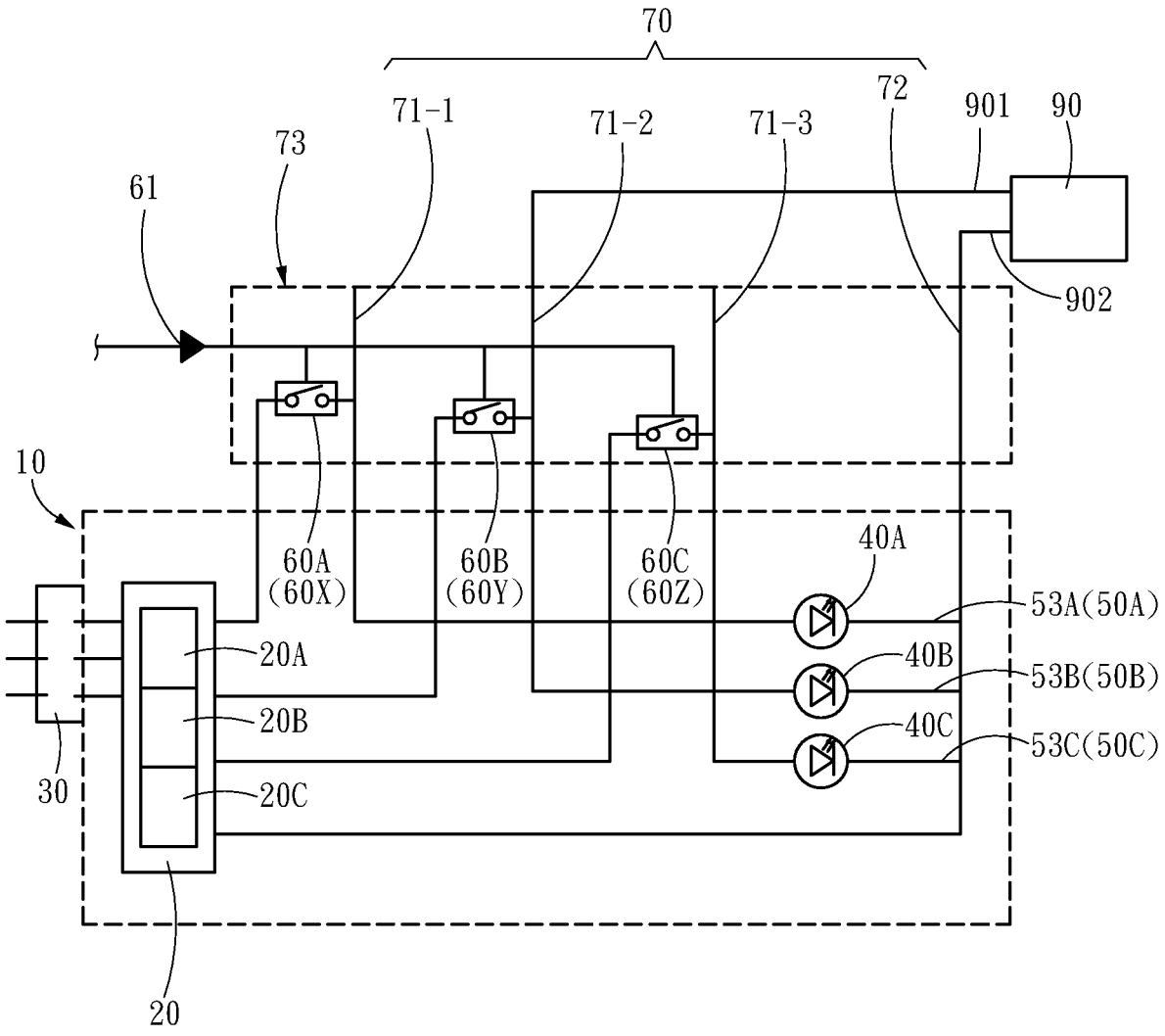
FIG. 9 is a schematic diagram of the automotive lighting unit according to the fourth embodiment of the present invention.

Referring to FIG. 9, the schematic diagram of the automotive lighting unit according to the fourth embodiment of the present invention is shown. In this embodiment, there are three drive power loops 50A, 50B, 50C correspondingly connected with three drive power supplies 20A, 20B, 20C, wherein each drive power loop 50A (50B, 50C) comprises a circuit channel 53A (53B, 53C), and each circuit channel 53A (53B, 53C) is provided with a light emitter diode light source 40A (40B, 40C) and a circuit breaker 60A (60B, 60C).

The circuit breakers 60A, 60B, 60C are disposed in the electrical measurement connection box 73 and the external electrical control signal cable 61 is used for providing the control signals. In the implementation, each circuit breaker 60A (60B, 60C) comprises a circuit switch 60X (60Y, 60Z) and is located on the circuit channel 53A (53B, 53C) to correspond to the light emitter diode light sources 40A (40B, 40C).

As show in FIG. 9, the three circuit switches 60X, 60Y, 60Z are all turned off, and the three circuit breakers 60A, 60B, 60C are all in the off-state, so that the three corresponding light emitter diode light sources 40A, 40B, 40C are all in the state of isolating from the corresponding drive powers and can be measured. Also, the ammeter connection line 70 comprises three positive electrode lines 71-1, 71-2, 71-3 and the negative electrode line 72 colinear with the positive electrode lines 71-1, 71-2, 71-3. The positive electrode lines 71-1, 71-2, 71-3 and the negative electrode line 72 are connected to the two ends of the light emitter diode light sources 40A, 40B, 40C of different circuit channels 53A, 53B, 53C respectively.

The current source electric meter 90 is implemented by any one of switching types selected from a jack-type change-over switch, a manual change-over switch, and an electrically controlled change-over switch to allow the positive line 901 and the negative line 902 being connected to the negative electrode line 72 and one of the positive electrode lines 71-1, 71-2, 71-3. In the embodiment shown in FIG. 9, the positive electrode line 71-2 and the negative electrode line 72 are connected to the current source electric meter 90 so as to measure the light emitter diode light sources 40B.

Figure 10:
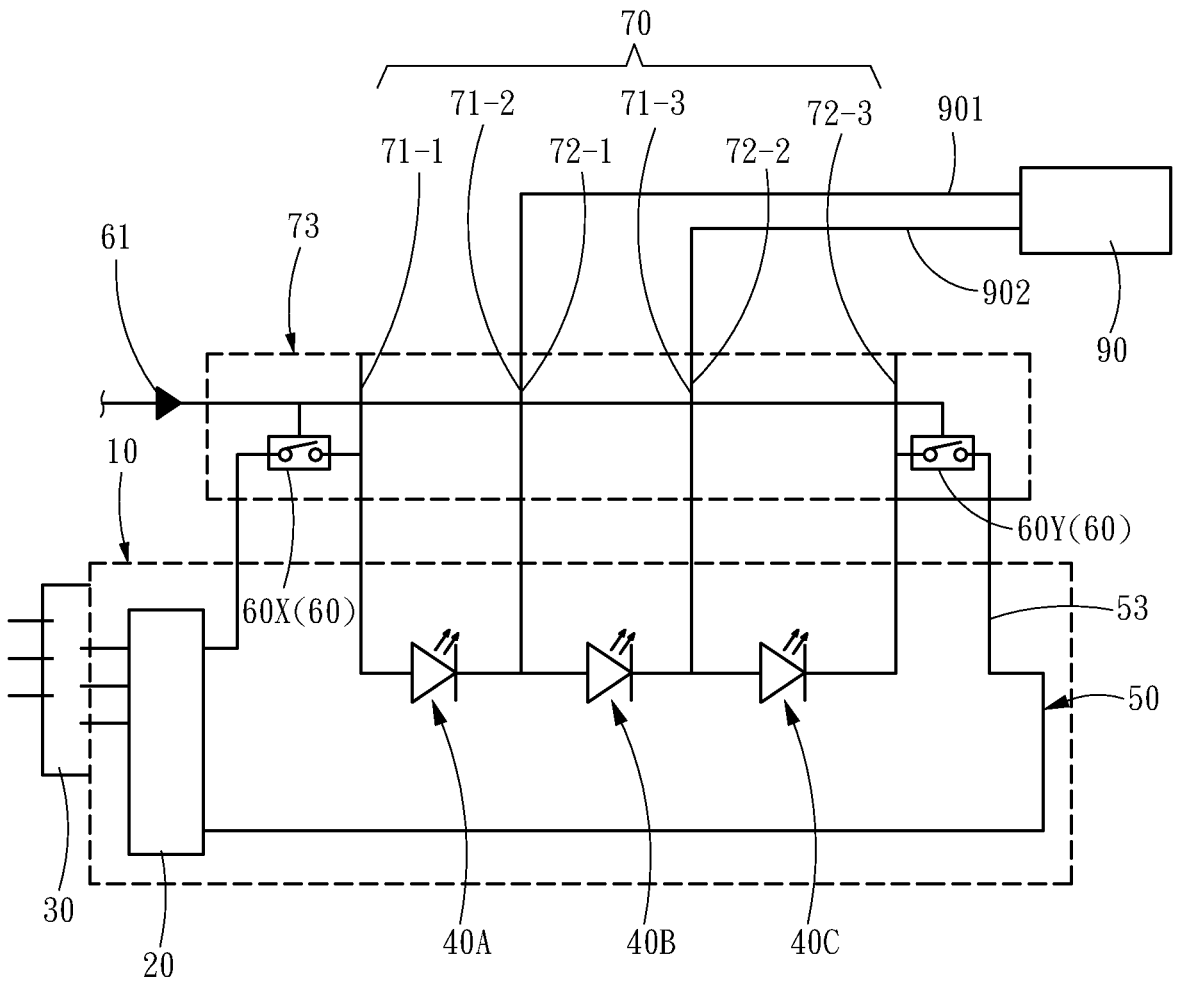
FIG. 10 is a schematic diagram of the automotive lighting unit according to the fifth embodiment of the present invention.

Referring to FIG. 10, the schematic diagram of the automotive lighting unit according to the fifth embodiment of the present invention is shown. In this embodiment, the drive power loop 50 comprises one circuit channel 53 which is provided with the three light emitter diode light sources 40A, 40B, 40C connected in series. The circuit breaker 60 comprises two circuit switches 60X, 60Y disposed at the foremost end and the rearmost end of the circuit channel 53, respectively, and the two circuit switches 60X, 60Y are arranged in the electrical measurement connection box 73. That is, the foremost end and the rearmost end of the circuit channel 53 with the light emitter diode light sources 40A, 40B and 40C are provided with the circuit switches 60X, 60Y, respectively.

The ammeter connection line 70 has the three positive electrode lines 71-1, 71-2, 71-3 and three negative electrode lines 72-1, 72-2, 72-3 which are connected with the two sides of the three light emitter diode light sources 40A, 40B, 40C, respectively, wherein parts of the positive electrode lines 71-1, 71-2, 71-3 and parts of the negative electrode lines 72-1, 72-2, 72-3 are collinear, that is, the positive electrode line 71-2 and the negative electrode line 72-1 are collinear, and the positive electrode line 71-3 and the negative electrode line 72-2 are collinear. For example, as shown in FIG. 10, in this state, the positive electrode line 71-2 and the negative electrode line 72-2 are connected to the current source electric meter 90.

Further, the current source electric meter 90 is implemented by any one of switching types selected from a jack-type change-over switch, a manual change-over switch, and an electrically controlled change-over switch to allow the positive line 901 and the negative line 902 being connected to different groups of the positive electrode lines 71-1, 71-2, 71-3 and the negative electrode lines 72-1, 72-2, 72-3, so that one of the light emitter diode light sources 40A, 40B, 40C can be selected for measurement.

Figure 11:
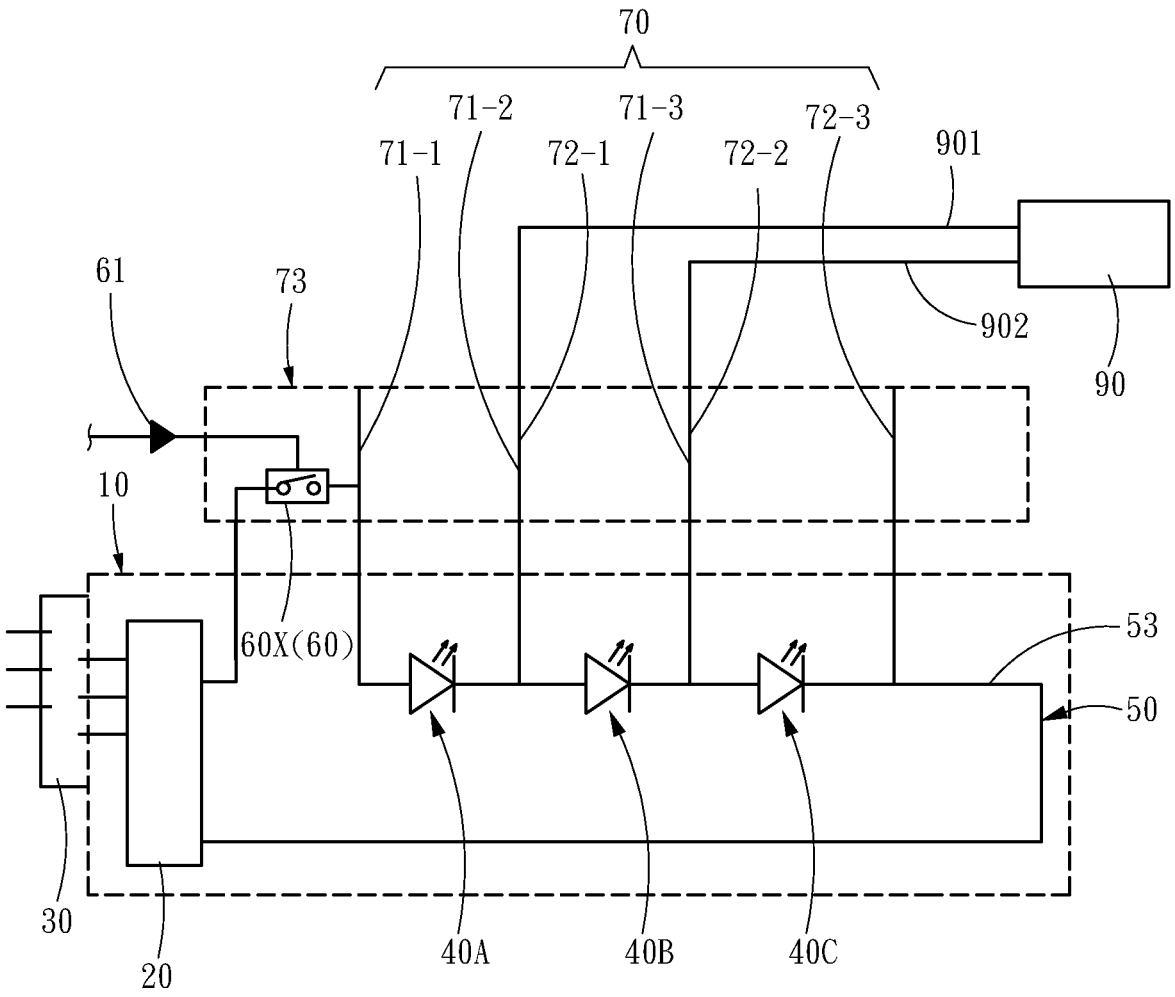
FIG. 11 is a schematic diagram of the automotive lighting unit according to the sixth embodiment of the present invention.

Referring to FIG. 11, the schematic diagram of the automotive lighting unit according to the sixth embodiment of the present invention is shown. In this embodiment, one drive power loop 50 is provided with the three light emitter diode light sources 40A, 40B, 40C which is able to be individually measured. This embodiment is different from the fifth embodiment in that the circuit breaker 60 is disposed at the foremost end of the circuit channel 53 only and has only one circuit switch 60X to control whether the three light emitter diode light sources 40A, 40B, 40C are in the state of isolating from the drive power. In the case that the circuit channel 53 does not have other parallel loops, the circuit breaker 60 on the circuit channel 53 only requires one circuit switch 60X to control the three light emitter diode light sources 40A, 40B, 40C on the circuit channel 53 be isolated from the drive power by turning the circuit switch 60X into the off-state. Thus, in the embodiment, only one of the foremost end and the rearmost end of the circuit channel 53 with the at least one light emitter diode light source 40A, 40B or 40C has to be selected to be provided with the circuit switch 60X (for example, the foremost end is selected to be provided with the circuit switch 60X as shown in FIG. 11).

Figure 12:
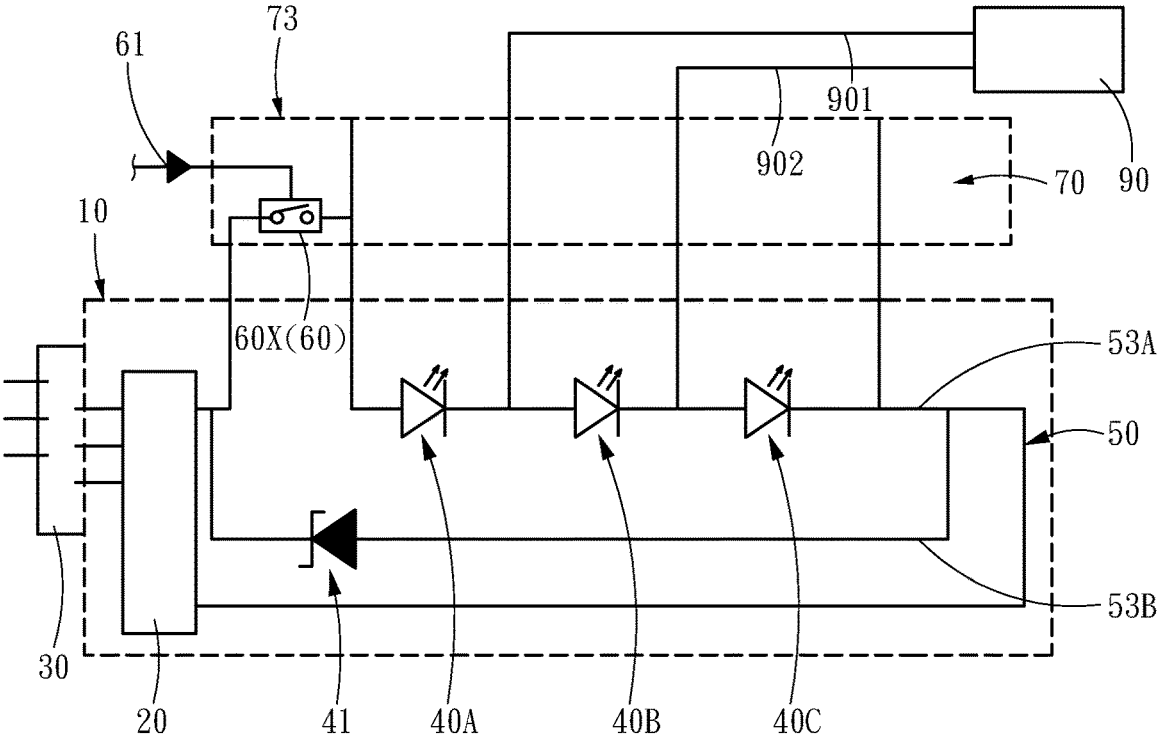
FIG. 12 is a schematic diagram of the automotive lighting unit according to the seventh embodiment of the present invention.

Referring to FIG. 12, the schematic diagram of the automotive lighting unit according to the seventh embodiment of the present invention is shown. In this embodiment, there is one drive power loop 50. The seventh embodiment is different from the sixth embodiment in that the drive power loop 50 comprises two circuit channels 53A, 53B which are connected in parallel, wherein one circuit channel 53A is provided with at least one of the light emitter diode light source 40A, 40B or 40C connected in series, and the other circuit channel 53B is provided with an antistatic protection component 41. The antistatic protection component 41 is any one selected from a Zener diode (unilateral or bilateral), a capacitor, a resistor and the like which achieves a protection function aiming to a static shock or a surge shock.

Figure 13:
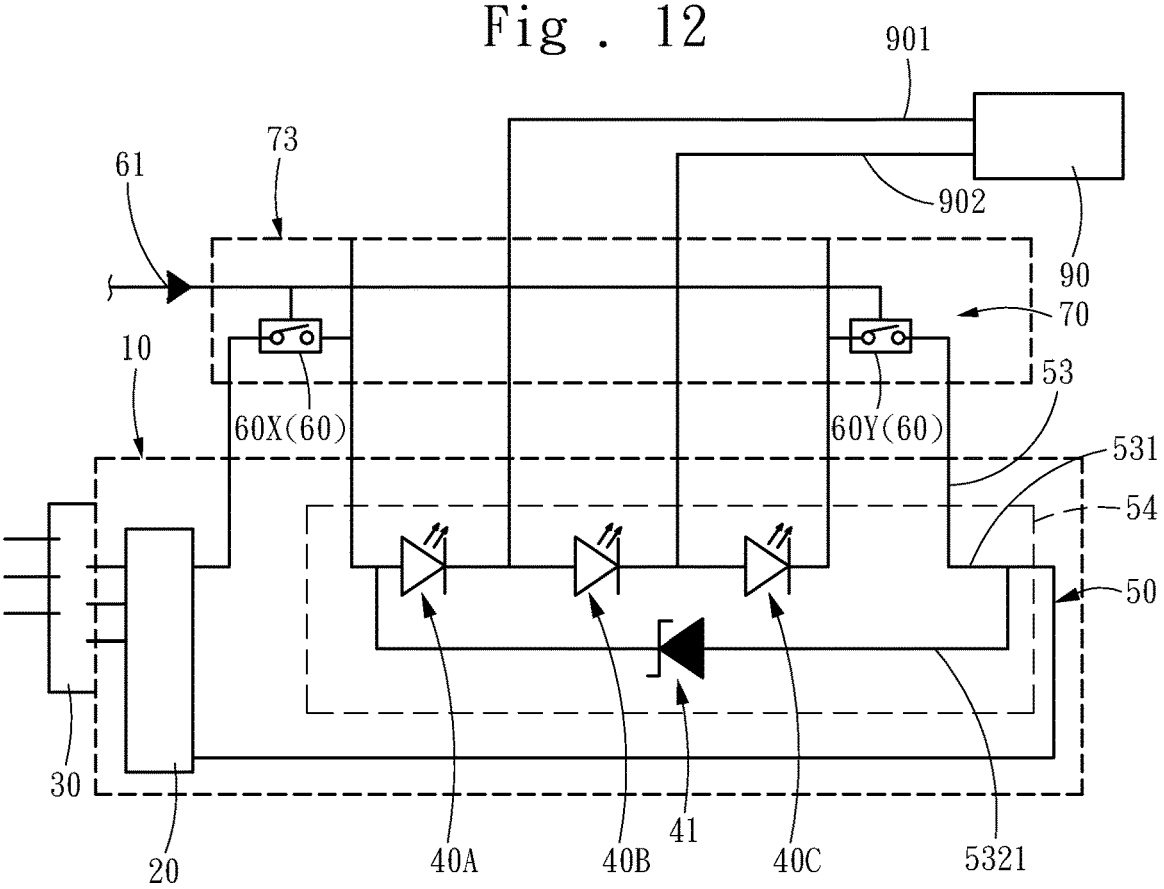
FIG. 13 is a schematic diagram of the automotive lighting unit frame according to the eighth embodiment of the present invention.

Referring to FIG. 13, the schematic diagram of the automotive lighting unit according to the eighth embodiment of the present invention is shown. The eighth embodiment is different from the sixth embodiment that the circuit breaker 60 requires two circuit switches 60X, 60Y in the drive power loop 50. Since the drive power loop 50 comprises a circuit channel 531 and a parallel circuit channel 5321 after the circuit switch 60X, the circuit switch 60Y is required to be added before convergence of the circuit channel 531 and the parallel circuit channel 5321 to actuate the circuit breaker 60. In addition, the three light emitter diode light sources 40A, 40B, 40C connected in series and the parallel antistatic protection component 41 (Zener diode) are packaged in a package carrier 54. The package carrier 54 is made of any one selected from a ceramic substrate, a BT (Bismaleimide Triazine) substrate, a copper substrate and a silicon carbide substrate, and the package carrier 54 is suitable for a circuit board of an automotive lighting module, which leads to relatively high automotive reliability and integrality.

After the at least one light emitter diode light source 40 is in the state of isolating from the drive power, the at least one light emitter diode light source 40 is measured by the current source electric meter 90. The following table is a measurement data table of the three light emitter diode light sources 40A, 40B, 40C (marked as LED-A, LED-B, LED-C in the table) in the eighth embodiment.

| (1 mm * 1 mm gallium nitride blue LED chips are measured) | | | Failure determination | Warning determination | Result |
|---|---|---|---|---|---|
| | Ir (μA) | $V_{f1}$ (V) | | | |
| LED-A | 0.6 μA | 3.01 V | | | Normal |
| LED-B | 2.8 μA | 3.06 V | | Ir > 2.0 μA | Warning (Ir) |
| LED-C | 0.1 μA | 5.62 V | $V_{f1} \geq 5$ V | | Failure ($V_{f1}$) |

LED-A, LED-B, and LED-C are 1 $mm^2$ gallium nitride (InGaN) blue LED chips, and the reverse leakage currents thereof are measured under the condition that the value of the reverse bias is −5V. The reverse leakage currents of LED-A, LED-B, and LED-C are 0.6 μA, 2.8 μA, and 0.1 μA, respectively. With respect to the characteristics of the traditional semiconductor, the LED is determined "Failure" if the leakage current exceeds 5 μA; the LED is determined "Warning" if the leakage current is between 2 μA and 5 μA; and the LED is determined "Normal" if the leakage current is lower than 2 μA. As shown in the table, the leakage current of LED-B is 2.8 μA so that LED-B is determined as "Warning", and the reason of which may be enlargement of a leakage current passage caused by defects of the semiconductor. Then, the forward voltages $V_{f1}$ of LED-A, LED-B, and LED-C are measured under the operation condition that the value of the current is 350 mA. The forward voltages of LED-A, LED-B, and LED-C are 3.01V, 3.06V, and 5.62V, respectively. With respect to the characteristics of the traditional semiconductor, the LED is determined "Failure" if the forward voltage exceeds 5V; the LED is determined "Warning" if the forward voltage is between 3.5V and 5V; and the LED is determined "Normal" if the forward voltage is lower than 3.5V. As shown in the table, the forward voltage of LED-C is 5.62V so that LED-C is determined as "Failure", and the reason of which may be that an interface or a wire in the chips and chip bonds deteriorate due to heating after being powered on. In practical implantation, if LED is determined as "Failure", the LED is necessarily repaired or changed immediately; whereas, if LED is determined as "Warning", the LED is required to be continuously noticed whether become worse or not.

As mentioned above, the present invention at least has the following characteristics:

1. The disadvantage that the LED chips in the traditional LED automotive lighting unit cannot be measured in quality is overcome, the LED automotive lighting unit is relatively expensive and complex, and the LED light source may be tested in diode characteristic curve for service life evaluation compared with a traditional light source. In the present invention, the at least one light emitter diode light source, on the same circuit channel with the drive power, may be in the state of isolating from the drive power by enabling the circuit breaker to be in the off-state, so that the at least one light emitter diode light source cannot be affected by external factors, such as a parallel loop. Therefore, LED chip detection may be conducted on the at least one light emitter diode light source by virtue of the ammeter connection line in sequence, the residual life of the LED chips of the at least one light emitter diode light source may be estimated through numerical values of measurement data to discover whether the light emitter diode light source is to be damaged or not, so that sudden failure of the at least one light emitter diode light source during driving is avoided so as to maintain the driving safety.

2. The present invention achieves the benefit with simple design and has modes of electrical control and manual control. The circuit breaker may meet various operation demands by using the external electrical control signal cable in the electrical control mode; whereas, in the manual control mode, application is simpler and is relatively low in cost. The circuit breaker provides different functions through the design of the first connection portion and the second connection portion of the double-ended connector for manual plugging respectively.

3. The present invention may better improve the safety of a self-driven automobile in unmanned driving; the electrical control mode of the present invention may be matched with the current source electric meter, and self detection of an automotive lighting of the self-driven automobile; and the self-driven automobile may detect the automotive lighting to prevent automotive lighting failure and then avoid an accident of crashing a passerby by mistake.

4. An integrated package body design is provided, so that the plurality of light emitter diode light sources and the parallel antistatic protection component are packaged in the same package carrier, and better light emitting characteristic and system integrality are achieved.

What is claimed is:

1. An automotive lighting unit for detecting electrical characteristics of a light emitter diode component, comprising:

an automotive lighting housing, comprising an automotive lighting housing interior space;

an LED drive module, disposed in the automotive lighting housing interior space and comprising at least one drive power supply, wherein each of the at least one drive power supply comprises a power supply positive terminal and a power supply negative terminal outputting a drive voltage;

a power and control cable, penetrating through the automotive lighting housing and electrically connected with the LED drive module;

at least one light emitter diode light source;

at least one drive power loop, correspondingly connected with the at least one drive power supply, wherein each of the at least one drive power loop is disposed in the automotive lighting housing interior space and comprises a first terminal and a second terminal, the first terminal is connected with the power supply positive terminal, the second terminal is connected with the power supply negative terminal, at least one circuit channel is provided between the first terminal and the second terminal, and the at least one light emitter diode light source is selectively disposed on any one of the at least one circuit channel;

at least one circuit breaker, correspondingly disposed on the at least one drive power loop, the at least one circuit breaker comprises at least one circuit switch disposed on the at least one circuit channel with the at least one light emitter diode light source, wherein the circuit breaker is in an on-state when the at least one circuit switch is controlled to be connected, and the circuit breaker is in an off-state when the at least one circuit switch is controlled to be disconnected, and when the circuit breaker is in the off-state, the corresponding at least one light emitter diode light source is isolated from a driving power; and an ammeter connection line, comprising at least one positive electrode line and at least one negative electrode line, the at least one positive electrode line and the at least one negative electrode line of the ammeter connection line are provided in pairs and are respectively connected to two sides of one of the at least one light emitter diode light source.

2. The automotive lighting unit according to claim 1, wherein the automotive lighting housing is any one selected from a head light, a fog light, a tail light, a side light and a projection headlight.

3. The automotive lighting unit according to claim 1, wherein a foremost end and a rearmost end of the at least one circuit channel with the at least one light emitter diode light source are provided with the at least one circuit switches respectively.

4. The automotive lighting unit according to claim 1, wherein one of a foremost end and a rearmost end of the at least one circuit channel with the at least one light emitter diode light source is provided with the at least one circuit switch.

5. The automotive lighting unit according to claim 1, wherein the automotive lighting unit further comprises an electrical measurement connection box, and the ammeter connection line is disposed in the electrical measurement connection box.

6. The automotive lighting unit according to claim 5, wherein the at least one circuit switch of the at least one circuit breaker is disposed in the electrical measurement connection box, and the at least one circuit switch is an electronically controlled circuit switch, and an electrical control signal transmitted to the at least one circuit switch is provided by an external electrical control signal cable outside the electrical measurement connection box.

7. The automotive lighting unit according to claim 5, wherein the electrical measurement connection box comprises a first connector and a second connector, the second connector is a double-ended connector which comprises a first connection portion and a second connection portion; and wherein the at least one circuit channel with the at least one light emitter diode light source extends into the first connector twice to form two circuit-breaker points in the first connector, and the at least one light emitter diode light source is disposed between the two circuit-breaker points; and wherein the first connection portion comprises two electrical connection portions which turn on the two circuit-breaker points respectively to serve as the circuit breaker, the second connection portion comprises two connection lines which serve as a positive electrode line and a negative electrode line respectively.

8. The automotive lighting unit according to claim 7, wherein a position that the first connection portion relative to the second connection portion is any one selected from a same side, an adjacent side and an opposite side of the double-ended connector.

9. The automotive lighting unit according to claim 7, wherein the first connection portion and the second connection portion of the double-ended connector are formed by combining two separate components.

10. The automotive lighting unit according to claim 1, wherein the at least one circuit switch of the at least one circuit breaker is disposed in the automotive lighting housing, and the at least one circuit switch is an electronically controlled circuit switch, and an electrical control signal transmitted to the at least one circuit switch is provided by an external electrical control signal cable outside an electrical measurement connection box.

11. The automotive lighting unit according to claim 1, wherein the at least one circuit switch of the at least one circuit breaker is an electronically controlled circuit switch, and the at least one circuit switch is any one selected from a relay and a semiconductor transistor.

12. The automotive lighting unit according to claim 1, wherein the at least one positive electrode line and the at least one negative electrode line in pairs are electrically connected to a current source meter, respectively according to an electrical property, and the current source meter is implemented by any one of switching types selected from a jack-type change-over switch, a manual change-over switch, and an electrically controlled change-over switch, and the current source meter is connected to different pairs of the positive electrode line and the negative electrode line.

13. The automotive lighting unit according to claim 1, wherein the at least one drive power loop comprises two circuit channels which are connected in parallel, one of the circuit channels is provided with the at least one light emitter diode light source in series, and the other circuit channel is provided with an antistatic protection component.

14. The automotive lighting unit according to claim 13, wherein the antistatic protection component is any one selected from a Zener diode, a capacitor and a resistor.

15. The automotive lighting unit according to claim 13, wherein the at least one light emitter diode light source and the antistatic protection component are packaged in one package carrier.

16. The automotive lighting unit according to claim 15, wherein the package carrier is selected from any one of a ceramic substrate, a BT (Bismaleimide Triazine) substrate, a copper substrate and a silicon carbide substrate.

* * * * *